United States Patent [19]

Sullivan

[11] Patent Number: 5,064,310

[45] Date of Patent: Nov. 12, 1991

[54] SHIPBOARD ENVIRONMENTAL BARRIER SYSTEM AND METHOD

[76] Inventor: Stephen T. Sullivan, 427 Lincoln Ave., Falls Church, Va. 22046

[21] Appl. No.: 482,765

[22] Filed: Feb. 21, 1990

[51] Int. Cl.[5] ..... E02B 15/04

[52] U.S. Cl. ..... 405/69; 405/63; 405/66; 405/68

[58] Field of Search ..... 405/63, 69, 60, 70, 405/66–68; 210/923, 924, 242.3; 102/504; 89/1.34; 42/1.14

[56] References Cited

U.S. PATENT DOCUMENTS

| | | | |
|---|---|---|---|
| Re. 27,640 | 5/1973 | Logan | 405/68 |
| 3,369,664 | 2/1968 | Dahan | 405/68 |
| 3,496,580 | 2/1970 | Gulmon et al. | 89/1.34 X |
| 3,599,434 | 8/1971 | Missud | 405/68 X |
| 3,641,770 | 2/1972 | Fitzgerald | 405/67 |
| 3,665,713 | 5/1972 | Rath | 405/66 X |
| 3,703,811 | 11/1972 | Smith | 405/70 X |
| 4,077,349 | 3/1978 | Paul | 89/1.34 X |
| 4,249,834 | 2/1981 | Bouvier | 405/63 X |
| 4,260,285 | 4/1981 | Kurihara et al. | 405/68 |
| 4,741,243 | 5/1988 | Snider | 102/504 X |

FOREIGN PATENT DOCUMENTS

| | | | |
|---|---|---|---|
| 0033921 | 2/1985 | Japan | 405/60 |
| WO8001580 | 8/1980 | PCT Int'l Appl. | 405/66 |

*Primary Examiner*—Dennis L. Taylor

*Attorney, Agent, or Firm*—Stephen T. Sullivan

[57] ABSTRACT

A system and method are provided for containing a contaminant in the vicinity of a water vehicle. The system comprises a barrier apparatus detachably coupled to the vehicle for operating in a deployed mode to erect a barrier at a perimeter around the vehicle to contain the contaminant, and a deploying subsystem operatively coupled to the barrier apparatus and to the vehicle for transporting the barrier apparatus from the vehicle to the perimeter during the deployed mode. The method comprises storing a barrier apparatus on the vehicle during a stored mode, transporting the barrier apparatus from the vehicle to a perimeter around and spaced from the vehicle during a deployed mode, and erecting a barrier at the perimeter to contain the contaminant.

19 Claims, 6 Drawing Sheets

SHIPBOARD ENVIRONMENTAL BARRIER SYSTEM AND METHOD

BACKGROUND OF THE INVENTION

1. Field of the Invention

The present invention relates to systems and methods for containing the spread of a contaminant released from a water vehicle such as a chemical tanker and, more specifically, to a system that can be integrated into or retrofitted onto such a water vehicle so the contaminant can be contained in a timely fashion, before significant dispersal has occurred.

2. Description of the Related Art

Water vehicles such as tankers and barges are cost effective means for transporting industrial quantities of bulk chemicals. Often such water vehicles are the only feasible means for transporting the chemicals. Barges typically transport quantities on the order of thousands of gallons, and supertankers typically transport millions of gallons. The devastation caused by the unintended release of chemicals from the vehicles has been well publicized. Money damages can easily run into the billions of dollars, and injury to wildlife and the environment is often irreparable.

Many of the bulk chemicals transported by water vessel are largely immiscible in water and have densities lower than that of water. The best example of this type of chemical is crude oil, but there are many others. This type of chemical will be referred to in this document as a contaminant. When a contaminant is released into the water, the contaminant resides in a substantially separate chemical phase on top of the water and undergoes lateral dispersion. Water movements from currents and other forces influence the dispersion, usually promoting it.

One method for channelling or containing the contaminant is to erect a physical barrier in the water. The barriers typically are stored in rolls at a coastal port or on an emergency vessel. When a spill is reported, the barriers are physically transported to the spill site where they are unrolled and deployed by personnel using smaller water vessels. The storage sites for the barriers often are distant, perhaps hundreds or thousands of kilometers, from a spill site. When a spill is reported, emergency crews must be assembled, equipment including the barriers must be readied and checked, and the crews and equipment must be transported to the spill site. The entire process from report of the spill to erection of the barriers usually takes hours and often takes days. By this time, the contaminant generally has dispersed over such a large area that significant containment is infeasible.

OBJECTS OF THE INVENTION

Accordingly, an object of the present invention is to provide a system and method for containing a contaminant in the vicinity of a water vehicle in a timely fashion after a release occurs, and before substantial dispersion has occurred.

Another object of the invention is to provide a system for containing a contaminant in the vicinity of the water vehicle wherein the system can be transported with the vehicle carrying the contaminant, and wherein the system is adaptable to a variety of vehicles.

Another object of the invention is to provide a system for containing a contaminant in the vicinity of a water vehicle wherein the system can be deployed automatically upon a contaminant release, with little or no human intervention.

Additional objects and advantages of the invention will be set forth in the description which follows, and in part will be apparent from the description, or may be learned by practice of the invention. The objects and advantages of the invention may be realized and obtained by means of the instrumentalities and combinations particularly pointed out in the appended claims.

SUMMARY OF THE INVENTION

To achieve these and other objects, and in accordance with the invention, a system is provided for containing a contaminant in the vicinity of a water vehicle. The system comprises barrier means detachably coupled to the vehicle for operating in a deployed mode to position a barrier at a perimeter around and spaced from the vehicle to contain the contaminant; and deploying means operatively coupled to the barrier means and to the vehicle for transporting the barrier means from the vehicle to the perimeter during the deployed mode.

The barrier means preferably comprises a flexible wall member having a ballast portion and a wall portion coupled to the ballast portion; and fluid supply means or injecting a fluid into the wall member during the deployed mode to cause the wall portion to extend from the ballast portion.

The ballast portion preferably comprises a ballast tube and the wall portion preferably comprises a wall cavity. In an alternative configuration, the ballast portion comprises a ballast tube and the wall portion comprises a plurality of wall tubes, one of the wall tubes being coupled to the ballast tube and selected ones of the wall tubes being coupled to an adjacent one of the wall tubes. The ballast tube and the wall tubes preferably comprise a plurality of segments and a corresponding plurality of valves, each of the segments including one of the valves for allowing passage of a fluid in a first direction and preventing passage of the fluid in a second direction opposite the first direction.

The fluid supply means preferably comprises fluid source means for containing a support fluid; and fluid transport means coupled to the fluid source means and to the wall member for transporting the support fluid from the fluid source means to the wall member. The fluid source means may comprise at least one of a compressed gas container, a fluid pump, and a chemical gas generator. The fluid transport means preferably comprises a plurality of fluid supply conduits.

The deploying means preferably includes projecting means disposed on the vehicle and coupled to the barrier mean for projecting the barrier means outwardly from the vehicle and toward the perimeter. The projecting means may comprise a barrel, a projectile operatively coupled to the barrier means and slidably mounted in the barrel, and pneumatic drive means for propelling the projectile through and out of the barrel. The pneumatic drive means may comprise at least one of a compressed gas container and a chemical gas generator. In an alternative configuration, the projecting means comprises a guide, a projectile operatively coupled to the barrier means and slidably mounted on the guide, and spring drive means for propelling the projectile along the guide.

The system preferably includes storing means disposed on the vehicle for storing the barrier means on the vehicle during a stored mode, the storing means including support means on which the barrier means is disposed, securing means for securing the barrier means on the support means, and actuating means coupled to the securing means for actuating the securing means to allow for deployment of the barrier means from the support means.

The method of the invention comprises storing a barrier apparatus on the vehicle during a stored mode; transporting the barrier apparatus from the vehicle to a perimeter around and spaced from the vehicle during a deployed mode; and erecting a barrier at the perimeter to contain the contaminant.

BRIEF DESCRIPTION OF THE DRAWINGS

The accompanying drawings, which are incorporated in and constitute a part of the specification illustrate a presently preferred system embodiment and method of the invention and, together with the description of the invention and its embodiments provided in this document, serve to explain the principles of the invention.

DETAILED DESCRIPTION OF THE PREFERRED SYSTEM EMBODIMENT AND METHOD

Figure 1:
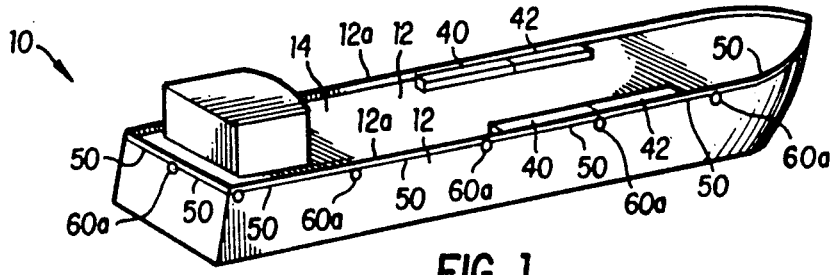
FIG. 1 shows a perspective view of a tanker into which the preferred system embodiment is incorporated, the system being in a stored mode.

The preferred system embodiment and method of the invention will now be described in detail with reference to the accompanying drawings, wherein like reference characters refer to like or corresponding parts throughout the drawings.

FIG. 1 shows a perspective view of a water vehicle 10 such as a bulk chemical tanker or supertanker into which a system according to the preferred system embodiment of the invention is incorporated. Tanker 10 includes an external bulkhead 12. By way of example, a gunwale 12*a* of bulkhead 12 is located approximately ten meters above the water line when the tanker is nonladen and approximately seven meters above the water line when the tanker is laden. Gunwale 12*a* of bulkhead 12 extends approximately one meter above the deck 14 of tanker 10.

Tanker 10 includes a number of internal holding tanks (not shown) mounted in the body of the ship under the deck for containing the transported bulk chemical. The bulk chemical, or contaminant, is assumed to be substantially immiscible in water and is assumed to have a density lower than that of water.

Accidental, unintended releases or spills of the contaminant can occur in a number of ways. For example, the tanker can collide with an obstacle such as an iceberg or another ship, or the tanker can run aground, thereby rupturing the holding tanks. Upon being released into the water in the immediate vicinity of the tanker, the contaminant will reside on the surface of the water, but will immediately begin dispersing or spreading away from the tanker in accordance with known principles. Water currents and other forces may significantly influence the dispersion process.

Figure 2:
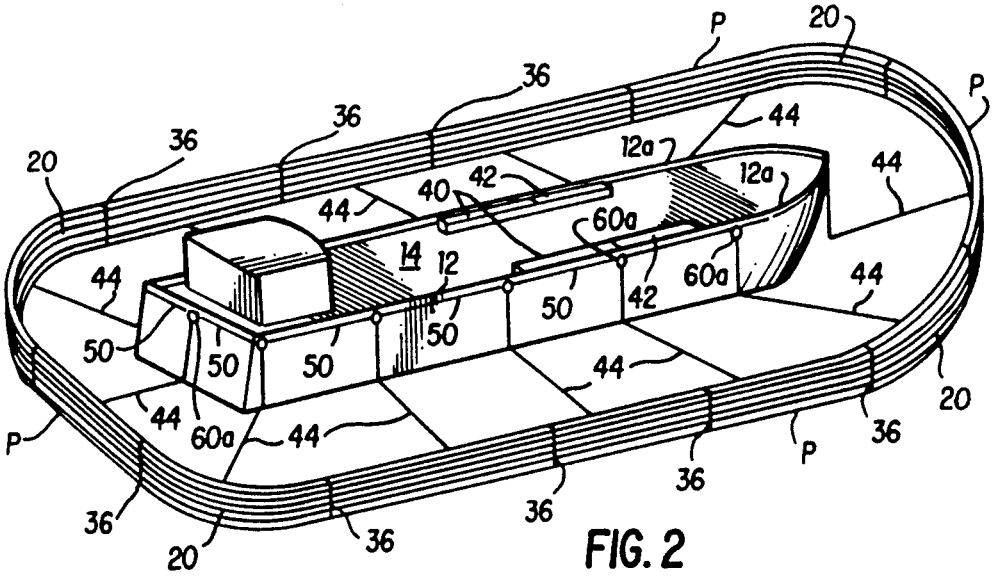
FIG. 2 shows a perspective view of the tanker and system of FIG. 1, the system being in a deployed mode.
Figure 3:
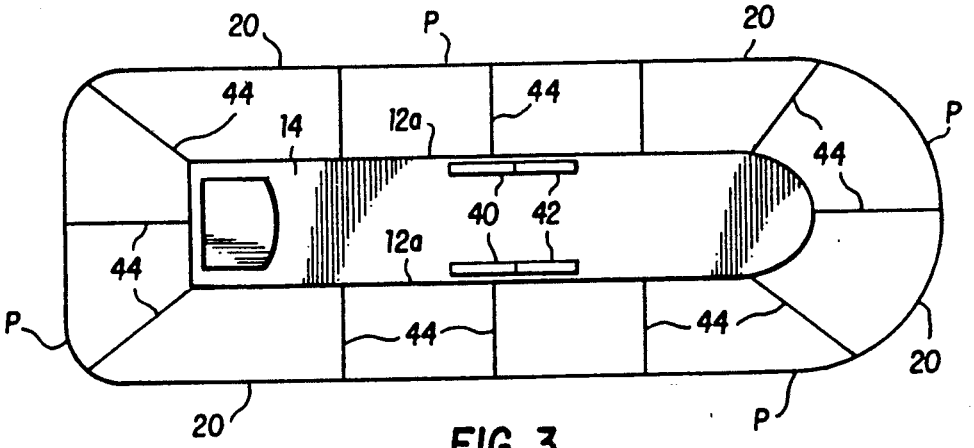
FIG. 3 shows a top view of the tanker and system of FIG. 1, the system being in the deployed mode.

The present invention comprises a system for containing the contaminant in the vicinity of the tanker or water vehicle. Containment is achieved by erecting a barrier at a perimeter P (FIGS. 2 and 3) around the vehicle in a timely fashion, before the contaminant has had an opportunity to significantly disperse. The invention is adapted to be configured in a stored mode, for example, as illustrated in FIG. 1, and in a deployed mode, for example, as illustrated in FIGS. 2 and 3.

In accordance with the invention, the system includes barrier means detachably coupled to the vehicle for operating in a deployed mode to erect a barrier at a perimeter around and spaced from the vehicle to contain the contaminant. The barrier means may comprise known barrier designs, or modifications of such designs, for physically containing the contaminant within a perimeter or area defined by the barrier. Such known designs may include tubular structures or sheet structures with flotation supports for suspending the sheet structures in the water at the water line. The barrier means is adapted to be disposed or stored on the water vehicle during normal operation of the vehicle.

The invention further includes deploying means operatively coupled to the barrier means and to the vehicle for transporting the barrier means from the vehicle to the perimeter during the deployed mode. A variety of designs are available for the deploying means. The deploying means of the preferred system embodiment comprises a pneumatic cannon system, and mechanical catapult systems and chemical gas generator systems are also discussed below. Other designs, however fall within the scope of the invention.

Although it is not to be construed as a necessary limitation, the barrier means preferably comprises a flexible wall member having a ballast portion and a wall portion coupled to the ballast portion. The barrier means serves as a physical barrier erectable at the perimeter around the vehicle to physically contain the contaminant.

In accordance with the preferred embodiment, the barrier means comprises a flexible wall member 20 having a ballast portion 22 and a wall portion 24 coupled to ballast portion 22. Wall member 20 is adapted to extend around the entire perimeter P of tanker 10, for example, at perimeter P having a radius from tanker 10 of about 20 to 50 meters.

Wall member 20 must be suitable for deployment in the types of environments in which tanker 10 is intended to operate. Such environments may include cold air temperatures (e.g., −20° F.), cold water temperatures (e.g., 32° F.), high wind conditions (e.g., gusts up to 40–50 knots), high water currents (e.g., up to 20–30 knots), and rough seas (e.g., 2–3 meter waves over 50 meters). Within the general requirements for a particular application and operating environment, a number of specific designs for wall member 20 are possible.

Figure 4A:
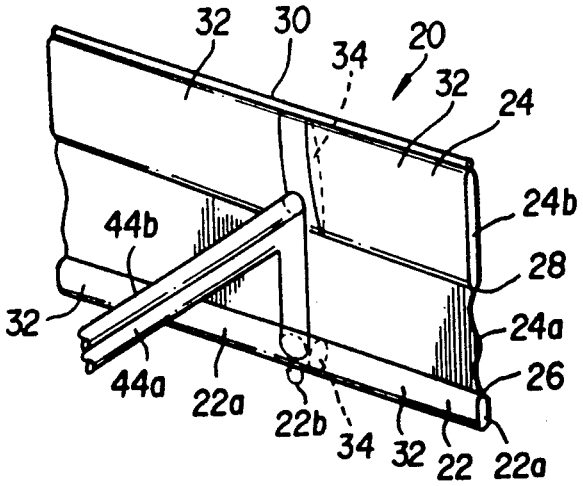
FIGS. 4A–D show a first configuration of a wall member, FIG. 4A being a perspective view, FIG. 4B being a cross sectional view, FIG. 4C showing the wall member folded, and FIG. 4D showing the wall member a line configuration.
Figure 4B:
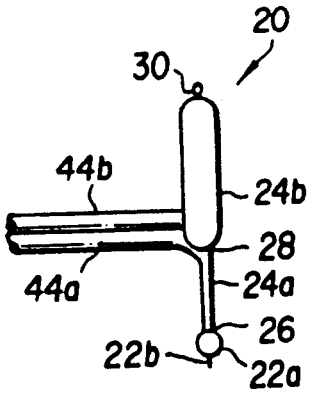

For example, as shown in FIGS. 4A and 4B, wall member 20 may comprise an inflatable structure in which ballast portion 22 comprises a ballast tube **22*a* and wall portion 24 comprises a wall panel 24*a* and a wall cavity 24*b*. Ballast tube 22*a* comprises a hollow, collapsible, air-tight tubular member formed of a flexible material such as, for example, a fabric-reinforced vinyl. Ballast tube 22*a* is adapted to be evacuated or deflated during the stored mode, and is adapted to be filled with a ballast fluid during the deployed mode. Ballast tube 22*a* also includes a plurality of eyelets 22*b* disposed on a lower folded seam of the lower edge of ballast tube 22*a*** at selected locations along the length of the tube.

Wall panel **24*a* is coupled along an edge 26 to an upper folded seam of ballast tube 22*a*, and at a continuous, liquid-tight seam 28 to a lower edge of wall cavity 24*b*. Wall cavity 24*b* forms an airtight cavity. A tension line 30, such as a rope or cable, is disposed at the top portion of wall cavity 24*b* to provide tension and to prevent wall cavity 24*b*** from unduly bowing.

Figure 4C:
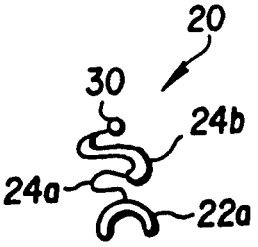
Figure 4D:
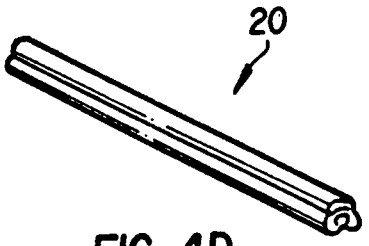

Ballast tube **22*a* and wall cavity 24*b* are adapted to be collapsible for the storage mode and inflatable or fillable during the deployed mode. The collapsibility of ballast tube 22*a* and wall cavity 24*b* is illustrated in FIGS. 4C and 4D. Ballast tube 22*a*, when evacuated, can be flattened. Wall panel 24*a* and, when evacuated, wall cavity 24*b* can be folded into a relatively small elongated bundle. The evacuated, flattened and folded wall member can then be wrapped to form a rope-like line configuration, as shown in FIG. 4D**.

An alternative configuration of wall member 20 is shown in FIGS. 5A–E. In this configuration, ballast portion 22 comprises a ballast tube, for example, ballast tube **22*a*, and wall portion 24 comprises a wall panel such as wall panel 24*a* and a plurality of wall tubes 24*c*. Ballast tube 22*a*** is collapsible, and is adapted to be filled with a ballast fluid upon deployment, as described above.

Wall panel **22*a* comprises a sheet-like material coupled at edge 26 to ballast portion 22, as described above. Wall panel 22*a* is coupled at edge 28 to one of wall tubes 24*c* by a fluid-tight seal. The tubes of wall portion 24 are coupled to one another in fluid-tight fashion. Each of the tubes is collapsible for storage, but is adapted to be filled or inflated with a support fluid upon deployment in the deployed mode to erect a barrier impenetrable by the contaminant. As shown in FIG. 5D, ballast tube 22*a* and wall tubes 24*c* can be collapsed, wall panel 24*a* can be folded, and the entire wall member assembly can be rolled to form a line configuration as shown in FIG. 5E**.

Figure 5A:
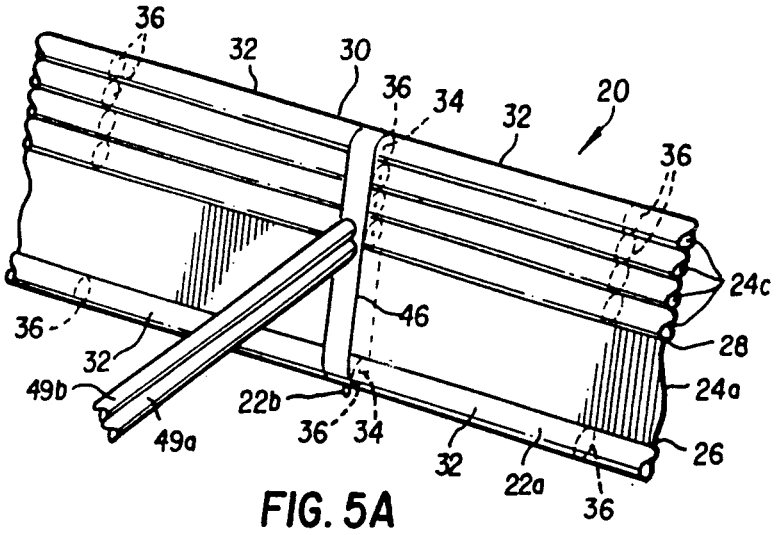
FIGS. 5A–E show a second configuration of a wall member, FIG. 5A being a perspective view, FIG. 5B being a cross sectional view, FIG. 5C showing the wall member viewed outwardly from the vehicle, FIG. 5D showing the wall member folded, and FIG. 5E showing the wall member in a line configuration.
Figure 5B:
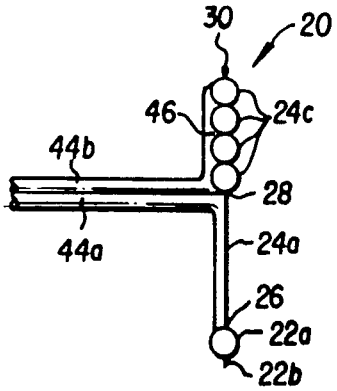
Figure 5C:
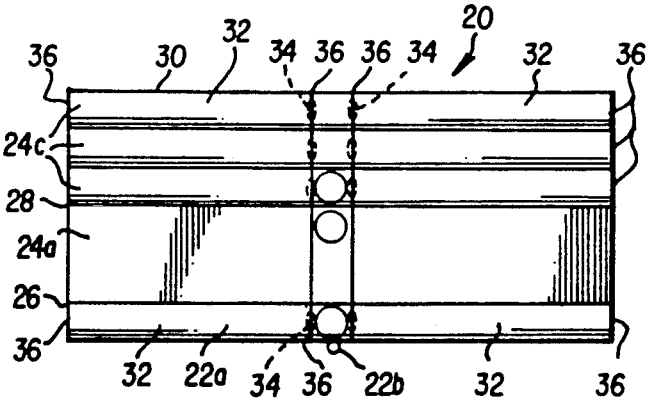
Figure 5D:
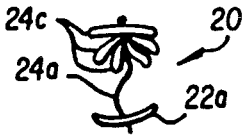
Figure 5E:
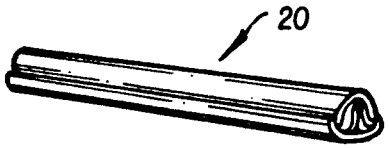
Figure 6A:
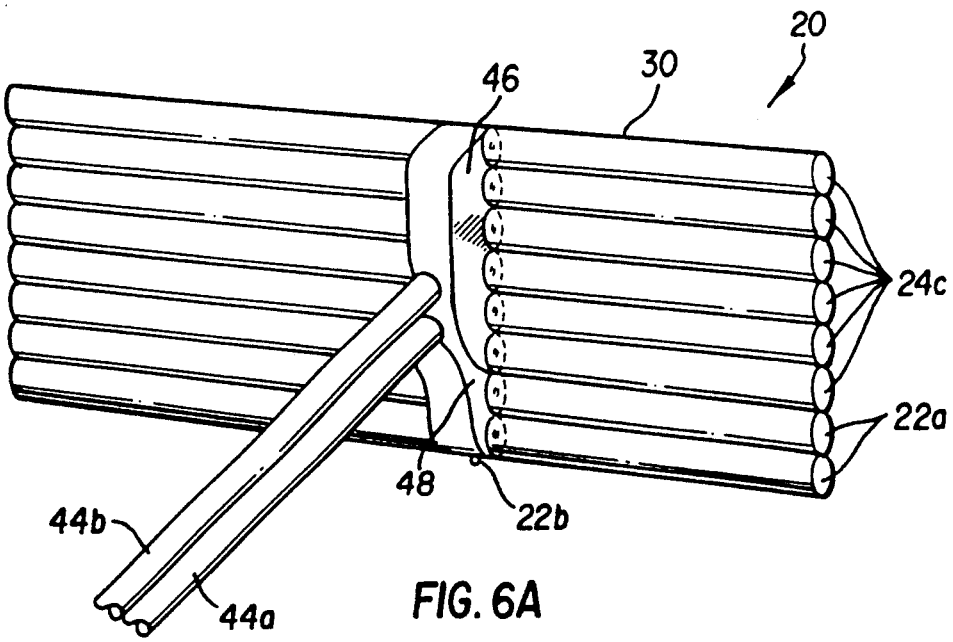
FIGS. 6A–D show a third configuration of a wall member, FIG. 6A being a perspective view, FIG. 6B being a cross sectional view, FIG. 6C showing the wall member folded, and FIG. 5D showing the wall member in a line configuration.
Figure 6B:
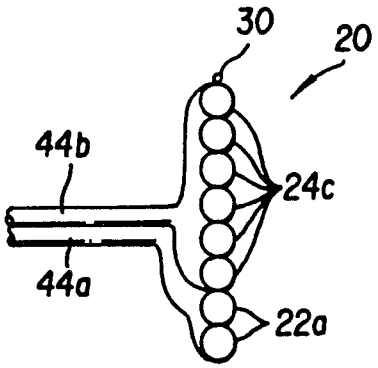
Figure 6C:
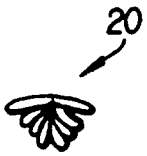
Figure 6D:
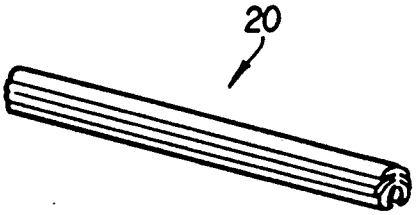

A third configuration of wall member 20 is shown in FIGS. 6A–D. This third configuration is similar to the second configuration of wall member 20 (FIGS. 5A–E), but differs in that two ballast tubes such as ballast tube **22*a* are provided and wall panel 24*a* is replaced by additional ones of wall tubes 24*c*. The configuration of FIG. 6A is collapsible, as shown in FIG. 6C, by flattening and rolling deflated or evacuated tubes 22*a* and 24*c* and rolling the assembly into a line configuration as shown in FIG. 6D**.

In each of the configurations of FIGS. 4A–D, 5A–E, and 6A–D, wall cavity **24*a* and/or wall tubes 24*c* comprise hollow, collapsible, air-tight tubular members formed of a flexible material such as, for example, a fabric or nylon reinforced vinyl. Wall panel 24*b*** comprises a sheet of such material. Known barrier materials would generally be acceptable.

The ballast tube, wall cavity, and wall tubes may comprise a single, elongated tube or cavity extending the entire length of wall member 20, i.e., the length of perimeter P. Preferably, however, the ballast tube, wall cavity and wall tubes comprise a plurality of segments and a corresponding plurality of valves, each of the segments including at least one of the valves for allowing passage of a fluid in a first direction into the segment, and preventing passage of the fluid in a second direction opposite the first direction, out of the segment. For example, with reference to FIG. 1, wall member 20 and its components (ballast tube, wall cavity, and wall tubes) preferably include a plurality of segments 32 disposed lengthwise along wall member 20 and a corresponding plurality of valves 34. Each segment is defined by a pair of closures 36, with at least one of the closures including a one-way valve 34 for each tube or cavity segment that allows fluid to enter the segment but prevents escape of the fluid from the segment. The other closure may be closed or sealed.

The ballast portion of each of the wall member configurations (FIGS. 4A–D, 5A–E and 6A–D) is adapted to be filled with a ballast fluid that weights the ballast portion to keep it submerged below the water line. The ballast fluid should have a density greater than water, but it should also have a viscosity sufficiently low that it can be pumped efficiently and it flows reasonably well through the ballast tube and related conduits. The ballast fluid should be inflammable and chemically inert with respect to its storage and transmission subsystems, including ballast tube **22*a***, and the ballast fluid should be ecologically benign in case of leaks, and to avoid toxicity while in storage on the tanker. Suitable ballast fluids would include slurries. A preferred ballast fluid would comprise a salt water and finely granulated sand slurry.

For each of the wall member configurations shown in the drawings, ballast tube **22*a* should have adequate strength to contain the ballast fluid under operating environments such as those described above. Ballast tube 22*a* should be impermeable to water and to the ballast fluid, and should be chemically inert with respect to both. The diameter of ballast tube 22*a*** should be sufficiently large that it contains enough ballast fluid to remain submerged, but sufficiently small that the ballast fluid can be quickly and efficiently pumped to fill the tube.

Wall cavity **24*b* of FIGS. 4A–D and wall tubes 24*c* of FIGS. 5A–E and 6A–D are adapted to be filled with a support fluid that inflates the cavity or tube to buoy it at or above the water line. The support fluid must have a lower density than water. The support fluid should be inflammable and chemically inert with respect to its storage and transmission subsystems including wall cavity 24***b* and wall tubes 24*c*. The supply fluid should also be chemically benign. The preferred support fluid is compressed air, although other gases such as helium and carbon dioxide are generally acceptable.

The barrier means preferably includes fluid supply means disposed on the vehicle and operatively coupled to the barrier means for injecting a fluid into the wall member during the deployed mode to cause the wall portion to extend from the ballast portion. In accordance with the preferred embodiment, the fluid supply means comprises both a ballast fluid supply subsystem and a support fluid supply subsystem. Each of these subsystems includes a fluid source means disposed on the vehicle for containing the respective ballast and support fluids and fluid transport means coupled to the fluid source means and to the respective ballast and wall portions of wall member 20 for transporting the fluids from the fluid source means to the wall member.

The fluid source means of the ballast fluid supply subsystem comprises a pressurized vessel 40 disposed on tanker 10 for containing the ballast fluid. Ballast fluid vessel 40 preferably comprises a slurry mixing tank and a pair of pumps (not shown). The slurry mixing tank contains finely granulated sand. One pump is disposed to pump water from outside the vehicle into the tank to create the slurry. The other pump is coupled to the slurry mixing tank and to a ballast fluid distribution system described more fully below.

The fluid source means of the support fluid supply subsystem comprises a pressurized vessel 42 disposed on tanker 10 for containing the support fluid. Because the preferred support fluid is compressed air, vessel 42 comprises a compressed air container and a high-pressure, high-volume air pump for pumping ambient air into the supply fluid distribution system described more fully below. The support fluid supply subsystem may, however, comprise a chemical gas generator which, upon activation, initiates a chemical reaction to produce a gaseous support fluid.

The fluid transport means preferably includes a plurality of fluid supply conduits operatively coupled to the fluid supply means and to the barrier means for transporting the ballast fluid and the support fluid to the barrier means. The fluid transport means or distribution system of the preferred embodiment includes a plurality of fluid supply lines 44. Each of fluid supply lines 44 comprises a ballast supply line 44*a* and a support fluid supply line 44*b*. Each ballast supply line 44*a* is coupled at one end to vessel 40 and at the other end to ballast tube 22*a*. Each support fluid supply line 44*b* is coupled at one end to vessel 42 and at the other end to wall cavity 24*b* and/or wall tubes 24*c*. With reference to FIG. 4A, ballast fluid supply line 44*a* is coupled in a sealed fashion to ballast tube 22*a* so that the ballast fluid pumped through ballast fluid supply line 44*a* toward ballast tube 22*a* enters ballast tube 22*a* to fill it. Support fluid supply line 44*b* is coupled in a sealed fashion to wall cavity 24*b* so that the support fluid (air) pumped through support fluid supply line 44*b* enters wall cavity 24*b* to fill it. Segment ends 36 and unidirectional valves 34 are disposed in ballast tube 22*a* and wall cavity 24*b* on either side of the junction at which the fluid supply lines meet wall member 20.

With reference to FIG. 5A, the coupling of ballast fluid supply line 44*a* to ballast tube 22*a* is as described above. Support fluid supply line 44*b* is coupled in a sealed fashion to each of wall tubes 24*c* so that the support fluid pumped through support fluid supply line 44*b* enters wall tubes 24*c* to fill them. A common duct 46 is used to couple the end of support fluid supply line 44*b* to apertures in wall tubes 24*c* enclosed by duct 46. Segment ends 36 and unidirectional valves 34 are disposed in the tubes on either side of duct 46.

With reference to FIG. 6A, the coupling of ballast fluid supply line 44*b* to ballast tubes 22*a* is as described above but includes a common duct 48. Support fluid supply line 44*b* is coupled in a sealed fashion to each of wall tubes 24*c* so that the support fluid pumped through support fluid supply line 44*b* enters wall tubes 24*c* to fill them. A common duct such as duct 46 is used to couple the end of support fluid supply line 44*b* to apertures in wall tubes 24*c* enclosed by duct 46. Again, segment ends 36 and unidirectional valves 34 are disposed in the tubes on either side of duct 46.

Figure 7A:
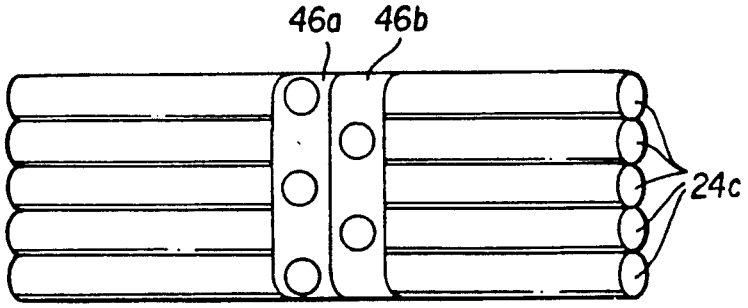
FIGS. 7A–C show a common duct arrangement, FIG. 7A being a perspective view, FIG. 7B being a cross sectional view, and FIG. 7C showing the duct arrangement viewed inwardly toward the vehicle.
Figure 7B:
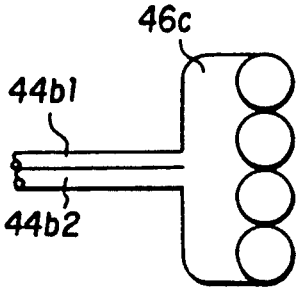
Figure 7C:
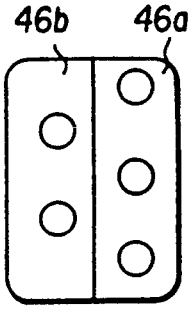

A modification of the support fluid supply line and duct arrangement is shown in FIGS. 7A–C. FIG. 7A shows a perspective view looking outwardly from vehicle 10 toward perimeter P, FIG. 7B shows a cross sectional view, and FIG. 7C shows an inward view of the common duct arrangement. In this modification, two support fluid supply lines 44*b*1 and 44*b*2 and two corresponding common ducts 46*a* and 46*b* are provided for supplying the support fluid to wall tubes 24*c*. Each support fluid supply line is coupled to a separate one of ducts 46*a* and 46*b*, and each duct is coupled to alternate ones of wall tubes 24*c* but not to the others of wall tubes 24*c*. This modification is advantageous in that it provides two separate enclosed systems for wall portion 24. One system, i.e., half of wall tubes 24*c*, will remain inflated even if the other supply conduit or system is ruptured.

The modified support fluid supply line and duct arrangement of FIGS. 7A–C can be further modified to include only a single support fluid supply line 44*b* coupled to a tubular T-connector in a portion 46*c*of duct 46. The arms of the T-connector are then connected via respective unidirectional fluid valves to respective common ducts 46*a* and 46*b*. Duct 46*a* is coupled to a first set of alternate ones of wall tubes 24*c* but not to a second set of alternate ones of wall tubes 24*c*. Duct 46*b* is coupled to the second set of alternate ones of wall tubes 24*c* but not to the first set of wall tubes 24*c*. This modification is advantageous in that it provides the feature of protection from ruptures of one system of wall portion 24 but requires only a single support fluid supply line, thus involving lower weight and less cost.

In each of the fluid supply line configurations described above, the portions of the fluid supply lines on board vehicle 10 preferably comprise rigid piping such as steel tubing. Portions of the fluid supply lines disposed between vehicle 10 and wall member 20 preferably comprise a flexible material such as those described above for the ballast tube 22*a*, wall cavity 24*a*, and wall tubes 24*c*.

In accordance with the invention, the system preferably includes storing means disposed on the vehicle for storing the barrier means on the vehicle during a stored mode, the storing means including support means on which the barrier means is disposed, securing means for securing the barrier means on the support means, and actuating means coupled to the securing means for actuating the securing means to allow for deployment of the barrier means from the support means.

Figure 8:
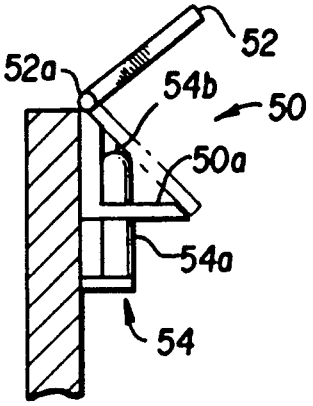
FIG. 8 shows a first configuration of a tray and cover assembly.

In the preferred system embodiment and with reference to FIGS. 1 and 8, the support means comprises a plurality of trays 50 rigidly coupled to top portion 12*a* of external bulkhead 12 on tanker 10. Trays 50 include a flat portion or surface 50*a* upon which the deflated wall member 20 in its line configuration (e.g., as shown in FIGS. 4D, 5E, and 6D) can be stored. Trays 50 are constructed of a material that is sufficiently rigid to support the weight of wall member 20, and sufficiently durable that the trays can withstand harsh weather and salt water conditions over extended periods without undue degradation. Examples include steel, aluminum, and fiberglass. Trays 50 are rigidly bonded at the top of external bulkhead 12 by suitable bonding means.

The securing means of the preferred embodiment comprises movable covers 52 for covering wall member 20 during storage on trays 50. With reference to FIG. 8, cover 52 may be hinged at a point 52*a* above tray 50 so that cover 52, when in a closed position (dashed lines), encloses and covers wall member 20 on tray 50 during storage, but cover 52, when in an open position (solid lines), frees wall member 20 to move off tray 50 in a direction away from external bulkhead 12, away from tanker 10 and toward perimeter P.

With reference to FIG. 8, the actuating means preferably comprises a plurality of actuators 54, each actuator being coupled to external bulkhead 12 or tray 50 and to one of covers 52 to selectively move the cover from the closed position to the open position. Each one of actuators 54 comprises a pneumatic cylinder 54*a* rigidly mounted to a back wall of tray 50 and having a piston rod 54*b* with its end movably coupled to the internal surface of cover 52. Cylinder 54*a* is coupled to a pneumatic controller (not shown) that maintains a slight vacuum to secure piston rod 54*b* in its retracted position and thereby secure cover 52 in its closed position during the stored mode. Upon actuation by the pneumatic controller, a positive pressure is applied to cylinder 54*a* which extends piston rod 54*b* and correspondingly forces cover 52 into its open position.

Figure 9:
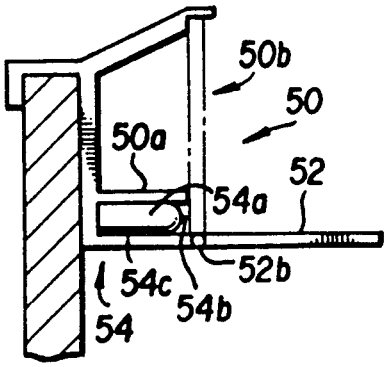
FIG. 9 shows a second configuration of a tray and cover assembly.

An alternative configuration for the trays and covers is shown in FIG. 9. This configuration is similar to the one shown in FIG. 8, but differs slightly in that each of trays 50 comprises a trapezoidal, box-like structure with an open side 50*b*, and cover 52 is movably coupled to open side 50*b* by a hinge 52*b* disposed at a lower edge of tray 50. Cover 52 assumes a closed position (dashed lines) during the stored mode, and an open position (solid lines) during the deployed mode. In this alternative configuration, the actuating means comprises a plurality of actuators such as actuators 54 coupled to external bulkhead 12 or tray 50 and to one of covers 52 to selectively move the cover from the closed position to the open position. Each one of the actuators comprises a pneumatic cylinder 54*a* rigidly mounted to a support flange 54*c* and having a piston rod 54*b* with its end movably coupled to the internal surface of the cover. Cylinder 54*a* is coupled to a pneumatic controller (not shown) that maintains a slight vacuum to secure piston rod 54*b* in its retracted position and thereby secure cover 52 in its closed position during the stored mode. Upon initiation of the deployed mode, the pneumatic controller applies a positive pressure to cylinder 54*a*, which extends piston rod 54*b* and correspondingly forces cover 52 into its open position.

Other actuator designs and configurations are possible in addition to the pneumatic systems shown and described. For example, the actuating means may comprise an electromagnetic or eIectromechanical actuator in which cylinders 54*a* are replaced by solenoids, and the pneumatic controller is replaced by a controlled electrical power supply or relay.

The invention further includes deploying means operatively coupled to the barrier means and to the vehicle for transporting the barrier means from the vehicle to the perimeter during the deployed mode, as indicated above. The deploying means preferably includes projecting means disposed on the vehicle and coupled to the barrier means for projecting the barrier means outwardly from the vehicle and toward the perimeter.

Figure 10:
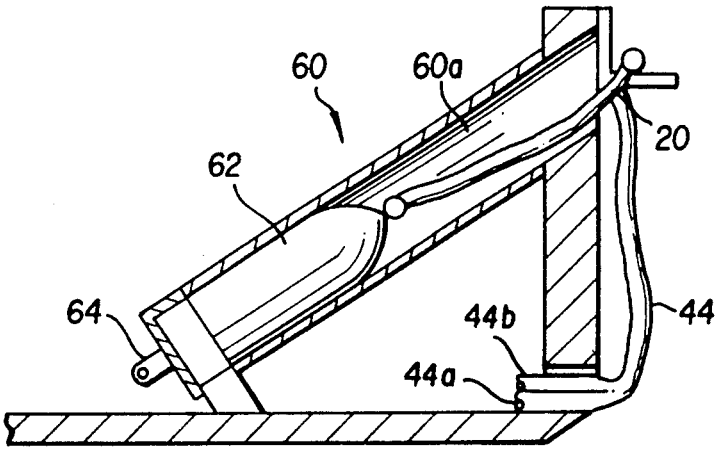
FIG. 10 shows a pneumatic cannon system for transporting the wall member from the vehicle to the perimeter.

The deploying means of the preferred embodiment includes a pneumatic cannon system in which the projecting means comprises a plurality of cannons 60 disposed at various locations around external bulkhead 12 and a corresponding plurality of projectiles 62 adapted to be projected or fired from the cannons. With reference to FIG. 10, each cannon 60 includes a barrel 60*a* disposed at and through exterior bulkhead 12 and oriented to launch projectile 62 outwardly toward perimeter P.

Figure 11:
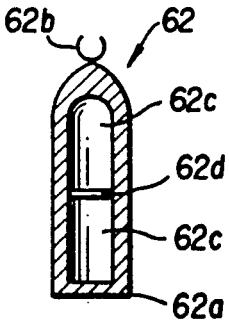
FIG. 11 shows an illustrative projectile for the cannon system of FIG. 10.

Projectile 62, an example of which is shown individually in FIG. 11, comprises a metallic shell having an aerodynamic shape similar to a conventional artillery shell. Projectile 62 has a base portion 62*a* that is slightly smaller than the interior dimensions of barrel 60*a* and slidably contacts the interior wall of barrel 60*a* in a substantially sealed fashion. A fastener 62*b* is provided at the nose of projectile 62 to couple wall member 20 to projectile 62. Fastener 62*b* includes a ringlet movably coupled to one of eyelets 22*b* of ballast tube, and a C-shaped seat member symmetrically disposed about the longitudinal axis of projectile 62 into which deflated wall member 20 is placed. The seat member has an opening that is covered by an adhesive tape or paper seal to secure the enclosed portion of wall member 20 in the seat member during the stored mode, but which ruptures upon inflation of wall member 20 by the ballast fluid and/or the support fluid.

Projectile 62 may comprise a solid device such as a metallic or solid plastic round having mass appropriate to provide proper momentum and aerodynamic stability during flight. Alternatively, projectile may be adapted to assume variable mass so that the optimum mass for a given application and operating environment can be selected. For example, as shown in FIG. 11, projectile 62 may include a pair of fluid-tight cavities 62*c* and 62*d* with a movable wall 62*e* disposed between the cavities. Cavity 62*d* is adapted to contain a high-density fluid, such as the ballast fluid or water, whereas cavity 62*d* is adapted to contain a low-density fluid such as air. Upon determining the selected mass appropriate for a given application and operating environment, cavity 62*c* is coupled to a high-density fluid source, cavity 62*d* is coupled to a low-density fluid source, and the pressure on the low-density fluid source is adjusted so that the appropriate amount of high-density fluid is placed in cavity 62*c*. There are, however, constraints on the spatial distribution of the fluids in projectile 62 that will result in an aerodynamically stable projectile based on known aerodynamic principles.

The projecting means further includes pneumatic drive means for propelling the projectile through and out of the barrel. The projecting means of the preferred embodiment comprises a compressed air system including a compressed air container (not shown) and a plurality of high pressure lines 64 coupled to the breach portion of respective ones of cannons 60. The capacity of the compressed air system is such that, when actuated, the pressure of the air in the breach portion of cannon 60 propels projectile 62 through and out barrel 60*a*.

The projecting means may assume forms other than the pneumatic projectile system described above. For example, the projecting means may comprise a chemical gas generator such as a squib or gun powder charge for explosively creating a volume-expansion sufficient to propel projectile through and out the barrel. Such a configuration might be desirable for applications in which inflammable contaminants are involved, but would be unacceptable for applications involving flammable or explosive contaminants.

Figure 12:
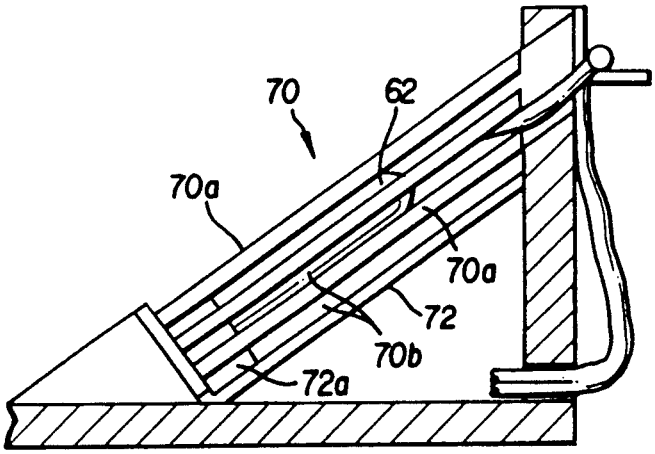
FIG. 12 shows a mechanical catapult system for transporting the wall member from the vehicle to the perimeter.

The projecting means may also comprise a mechanical system such as a spring or catapult system. For example, as shown in FIG. 12, the projecting means may comprise a guide 70, a projectile such as projectile 62 coupled to the wall member 20 and slidably mounted on the guide, and spring drive means for propelling the projectile along the guide. Guide 70 comprises a set of curvalinear rails 70*a* disposed adjacent to one another to direct projectile 62 outwardly from the vehicle and toward the perimeter Rails 70*a* are spaced by a gap 70*b*. The spring drive means comprises a catapult 72 disposed below gap 70*b* and having a flange 72*a* to engage the aft end of projectile 62 and propel it along guide 70.

Having described the preferred system embodiment, the preferred method of the invention for containing a contaminant in the vicinity of a water vehicle will now be described. For illustrative purposes and not by way of limitation, the preferred method of the invention will be described with reference to the preferred system embodiment of the invention.

In accordance with the invention, the method includes storing a barrier apparatus on the vehicle during a stored mode. In the preferred method as applied to the preferred system embodiment, the barrier apparatus comprises wall member 20. The preferred system embodiment is placed in the stored mode as follows. Wall member 22 and supply lines 44*a* and 44*b* are evacuated and folded or compressed to place them in the line configurations shown in the appropriate one of FIGS. 4D, 5E and 6D. With covers 52 in the open position, deflated wall member 20 and supply lines 44*a* and 44*b* are then placed in tray 50. Portions of deflated wall member 20 and supply lines 44*a* and 44*b* will be folded or doubled lengthwise to account for the excess length of wall member 20 relative to the perimeter of external bulkhead 12. Covers 52 are then moved to the closed position to secure deflated wall member 20 and supply lines 44*a* and 44*b* onto tray 50.

Figure 13:
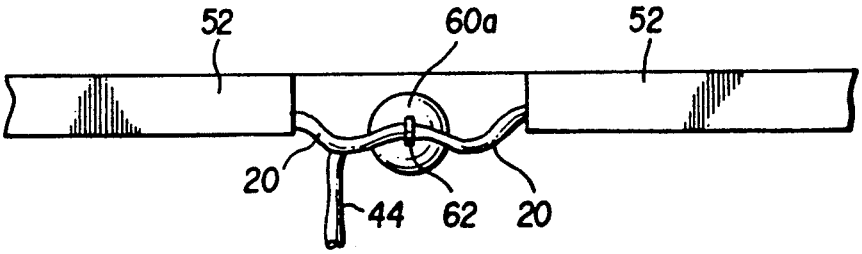
FIG. 13 shows a inward view of the tray and cannon system, the preferred system being in the stored mode.

Projectiles 62 are coupled to eyelets 22*b* of ballast tube 22 via ringlets of the projectile. Deflated wall member 20 is placed in the seat member of fastener 62*b* and a seal is applied to secure wall member 20 in the seat member. Projectile 62 is lowered into barrel 60*a* until it seats in the breach portion. The breach portion of the barrel is then secured in a closed and locked position to enclose the breach chamber. This procedure is carries out for each of the cannons. The barrel of a cannon in the stored mode is shown in FIG. 13.

The method of the invention further includes transporting the barrier apparatus from the vehicle to a perimeter around and spaced from the vehicle during a deployed mode. When a contaminant spill occurs, the preferred method assumes the deployed mode in which wall member 20 in its deflated line configuration is transported from tray 50 to perimeter P. The deployed mode can be initiated either manually or by means of an automatic spill detection and deployment system. Upon initiation, actuators 54 are activated to move covers 52 to the open position. The compressed air system of the cannon system is then actuated to apply high pressure air to the breach portion of cannons 60 via compressed air lines 64, thus causing projectiles 62 to be propelled through and out barrels 60*a* toward perimeter P. Deflated wall member 20 in its line configuration is carried by projectiles 62 to perimeter P.

The method of the invention further includes erecting a barrier at the perimeter to contain the contaminant. When wall member 20 has reached perimeter P and is resting in the water, supply lines 44 will be substantially extended between vehicle 10 and wall member 20. The ballast fluid and the support fluid are then caused to flow from vessels 40 and 42, respectively, through respective supply lines 44*a* and 44*b* to ballast tubes 22*a* and wall tubes 24*c*, respectively, assuming the wall portion configuration of FIG. 6*a* is used. As ballast tubes 22*a* are filled, they submerge below the water line to prevent seepage of the containment under the wall member. As wall tubes 24*c* are inflated, they extend out of the water and erect a physical barrier to contain the contaminant within wall member 20 and within perimeter P. Wall member 20 can then be selectively supported with structural or mechanical supports erected between vessel 10 and wall member 20 to prevent undue movement of the barrier relative to the vehicle, for example, from forces of winds and water currents. Having physically contained the contaminant within the wall member 20, the contaminant can later be pumped from the contained perimeter into another tanker when one later arrives.

Having now described the presently preferred system embodiment and method of the invention, additional advantages and modifications will readily occur to those skilled in the art. For example, barrier systems other than those described in detail above, including known barrier designs, could be used. The ballast tubes could also be replaced with a solid ballast line or cable. Accordingly, the invention in its broader aspects is not limited to the specific details, representative apparatus and illustrative examples shown and described. Departures may be made from such details without departing from the spirit or scope of the general inventive concept as defined by the appended claims and their equivalents.

I claim:

1. A system for containing a contaminant in water in the vicinity of a water vehicle, the system comprising:

barrier means for operating in a deployed mode at a perimeter in the water around and spaced from the vehicle to contain the contaminant; and projecting means disposed on the vehicle and operatively coupled to the barrier means for accelerating the barrier means outwardly from the vehicle to project the barrier means over the water toward the perimeter during the deployed mode so that the barrier means moves in a substantially free fall trajectory after the acceleration.

2. A system as recited in claim 1, wherein:

the barrier means comprises a flexible wall member having a ballast portion and a wall portion coupled to the ballast portion; and the system further includes fluid supply means for injecting a fluid into the wall member during the deployed mode to cause the wall portion to extend from the ballast portion.

3. A system as recited in claim 2, wherein the ballast portion comprises a ballast tube containing a ballast fluid during the deployed mode and the wall portion comprises a wall cavity containing a support fluid during the deployed mode.

4. A system as recited in claim 2, wherein the ballast portion comprises a ballast tube containing a ballast fluid during the deployed mode and the wall portion comprises a plurality of substantially parallel wall tubes of substantially equal size, one of the wall tubes being coupled to the ballast tube and others of the wall tubes being coupled to one another to form a barrier that is substantially impenetrable by the contaminant.

5. A system as recited in claim 4, wherein the ballast tube and the wall tubes comprise a plurality of segments and a corresponding plurality of valves, each of the segments including one of the valves for allowing passage of a fluid in a first direction and preventing passage of the fluid in a second direction opposite the first direction.

6. A system as recited in claim 2, wherein the fluid supply means comprises:

ballast fluid source means for providing a ballast fluid; and fluid transport means coupled to the ballast fluid source means and to the wall member for transporting the ballast fluid from the ballast fluid source means to the wall member.

7. A system as recited in claim 6, wherein the ballast fluid comprises a granulated solid and the ballast fluid source means comprises a mixer and a fluid pump.

8. A system as recited in claim 6, wherein the fluid transport means comprises a plurality of fluid supply conduits.

9. A system as recited in claim 1, wherein the projecting means comprises a barrel, a projectile operatively coupled to the barrier means and slidably mounted in the barrel, and pneumatic drive means for propelling the projectile through and out of the barrel.

10. A system as recited in claim 9, wherein the pneumatic drive means comprises at least one of a compressed gas container and a chemical gas generator.

11. A system as recited in claim 1, wherein the projecting means comprises a guide, a projectile operatively coupled to the barrier means and slidably mounted on the guide, and spring drive means for propelling the projectile along the guide.

12. A system as recited in claim 12, wherein the projectile contains a ballast fluid.

13. A system as recited in claim 1, further including storing means disposed on the vehicle for storing the barrier means on the vehicle during a stored mode, the storing means including a support tray assembly having a surface on which the barrier means is disposed and an opening facing outwardly from the vehicle, securing means for securing the barrier means on the support tray assembly, and actuating means coupled to the securing means for actuating the securing means to allow for deployment of the barrier means from the support tray assembly.

14. A method for containing a contaminant in water in the vicinity of a water vehicle, the method comprising:

storing a barrier apparatus on the vehicle during a stored mode;

accelerating the barrier apparatus outwardly from the vehicle to project the barrier apparatus over the water toward a perimeter in the water around and spaced from the vehicle during a deployed mode so that the barrier apparatus follows a substantially free fall trajectory after the acceleration; and erecting the barrier apparatus substantially at the perimeter to contain the contaminant.

15. A system as recited in claim 4, wherein the wall portion comprises at least four wall tubes.

16. A system as recited in claim 6, wherein the ballast fluid comprises a slurry comprising sand.

17. A system as recited in claim 10, wherein the projectile contains a ballast fluid.

18. A system as recited in claim 10, wherein the projectile has a variable mass.

19. A system as recited in claim 12, wherein the projectile has a variable mass.

* * * * *